US008871002B2

(12) United States Patent
Chen et al.

(10) Patent No.: US 8,871,002 B2
(45) Date of Patent: Oct. 28, 2014

(54) TECHNOLOGICAL METHOD FOR PREPARING SPONGE TITANIUM FROM SODIUM FLUOTITANATE RAW MATERIAL

(75) Inventors: Xuemin Chen, Guangdong (CN); Jun Yang, Guangdong (CN); Zhi Zhou, Guangdong (CN)

(73) Assignee: Shenzhen Sunxing Light Alloys Materials Co., Ltd., Shenzhen, Guangdong (CN)

( * ) Notice: Subject to any disclaimer, the term of this patent is extended or adjusted under 35 U.S.C. 154(b) by 148 days.

(21) Appl. No.: 13/585,783

(22) Filed: Aug. 14, 2012

(65) Prior Publication Data

US 2012/0304824 A1 Dec. 6, 2012

(30) Foreign Application Priority Data

Jan. 18, 2012 (CN) ..... 2012 1 0014899

(51) Int. Cl.
*C22B 34/12* (2006.01)

(52) U.S. Cl.
CPC ..... *C22B 34/1277* (2013.01); *C22B 34/1272* (2013.01)
USPC ..... 75/616; 75/618; 75/319; 75/620

(58) Field of Classification Search
CPC ..... C22B 34/1272; C22B 34/1277
USPC ..... 75/616, 618–620
See application file for complete search history.

(56) References Cited

U.S. PATENT DOCUMENTS

| | | | | | |
|---|---|---|---|---|---|
| 2,785,971 | A | * | 3/1957 | Kamlet | 75/419 |
| 2,823,991 | A | * | 2/1958 | Kamlet | 75/615 |
| 4,390,365 | A | * | 6/1983 | Hard et al. | 75/419 |
| 4,468,248 | A | * | 8/1984 | Megy | 75/615 |

* cited by examiner

*Primary Examiner* — George Wyszomierski
*Assistant Examiner* — Tima M McGuthry Banks
(74) *Attorney, Agent, or Firm* — Jackson IPG PLLC

(57) ABSTRACT

The invention provides a technological method for preparing sponge titanium from sodium fluotitanate raw material, comprising the following steps: step A: placing aluminum in an airtight resistance furnace, evacuating, introducing inert gas into the resistance furnace, and heating the aluminum to obtain molten aluminum; step B: opening a reactor cover, adding a proper amount of sodium fluotitanate into the reactor, closing the reactor cover, detecting leakage, slowly heating the reactor to 150° C., evacuating and continuously heating the reactor to 250° C.; step C: introducing inert gas into the reactor, continuously heating the reactor to 900° C., and stirring uniformly; step D: opening a valve, adjusting the stirring speed, dripping the molten aluminum, and controlling the temperature of reaction in a range from 900 to 1000° C.; and step E: opening the reactor cover, removing a stirring device out of the reactor, and eliminating $NaAlF_4$ at upper layer to obtain sponge titanium.

10 Claims, No Drawings

TECHNOLOGICAL METHOD FOR PREPARING SPONGE TITANIUM FROM SODIUM FLUOTITANATE RAW MATERIAL

TECHNICAL FIELD OF THE INVENTION

The invention relates to a technological method for preparing sponge titanium from sodium fluotitanate raw material, more particularly to a technological method for preparing sponge titanium from sodium fluotitanate raw material, which has the advantages of low cost, high efficiency and continuous operation.

BACKGROUND OF THE INVENTION

The sponge titanium production process that has been well-known domestically and overseas mainly is: metallothermic reduction process, especially the process for preparing metal M by means of t reaction between metallic reducing agent (R) and metal oxides or chlorides (MX). The titanium metallurgy processes that have been brought to industrial production are magnesiothermic reduction process (Kroll process) and sodiothermic reduction process (Hunter process). Only Kroll process has been widely used in industry so far because its production cost is lower than the production cost of Hunter process. Kroll process mainly includes the technological flow as follows: after the removal of oxide film and impurities, a magnesium ingot is placed in a reactor and then heated to melt, titanium tetrachloride ($TiCl_4$) is then introduced into the reactor to generate titanium particle deposition by dint of reaction, and the liquid magnesium chloride generated is discharged out in time through a residue port. The reaction temperature is typically kept in a range from 800 to 900° C., and the reaction time ranges from several hours to several days. The remaining metal magnesium and magnesium chloride in the final product can be either washed away by hydrochloric acid or distilled out under vacuum at the temperature of 900° C., and meanwhile, high purity of titanium is maintained. The defects of Kroll process lie in high cost, long production cycle and environmental pollution, thus limiting its further application and popularization. Up to the present day, no change has been accomplished on this process, and it is still applied to intermittent production and fails to realize continuous production.

SUMMARY OF THE INVENTION

To solve the defects in the prior art, such as high cost, severe pollution and long production cycle, the invention provides a technological method for technological production of sponge titanium:

Proposal 1: method for preparing titanium from sodium fluotitanate by aluminothermic reduction process The equation related is as follows:

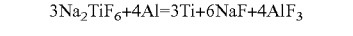

$$3Na_2TiF_6+4Al=3Ti+6NaF+4AlF_3$$

Proposal 2: method for preparing sponge titanium from sodium fluotitanate by magnesiothermic reduction process:

The equation related is as follows:

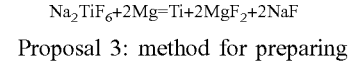

$$Na_2TiF_6+2Mg=Ti+2MgF_2+2NaF$$

Proposal 3: method for preparing sponge titanium from sodium fluotitanate by aluminum-magnesium thermal reduction process:

The equations related are as follows:

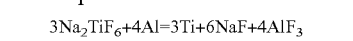

$$3Na_2TiF_6+4Al=3Ti+6NaF+4AlF_3$$

$$Na_2TiF_6+2Mg=Ti+2MgF_2+2NaF$$

Sodium fluotitanate, aluminum and magnesium in raw materials are solid, so the devices for preparing sponge titanium in the invention include: a reactor and a reactor cover with a stirring device, wherein a sealing ring is arranged between the reactor cover and the reactor; a lifting device for controlling the lifting of the reactor cover is arranged on the side surface of the reactor cover, an airtight resistance furnace is further arranged above the reactor cover, a valve is arranged below the resistance furnace; and an evacuating tube and a gas filling tube are arranged above the reactor cover.

Correspondingly, the invention provides a technological method for preparing sponge titanium from sodium fluotitanate raw material, comprising the following steps:

step A: placing aluminum in the airtight resistance furnace, evacuating, introducing inert gas into the resistance furnace, and heating the aluminum to obtain molten aluminum;

step B: opening the reactor cover, adding a proper amount of sodium fluotitanate into the reactor, closing the reactor cover, detecting leakage, slowly heating the reactor to 150° C., evacuating and continuously heating the reactor to 250° C.;

step C: introducing inert gas into the reactor, continuously heating the reactor to 900° C., and stirring uniformly;

step D: opening the valve, adjusting the stirring speed, dripping the molten aluminum, and controlling the temperature of reaction in a range from 900 to 1000° C.;

and step E: opening the reactor cover, removing the stirring device out of the reactor, and eliminating $NaAlF_4$ at upper layer to obtain sponge titanium.

The invention further provides a second technological method for preparing sponge titanium from sodium fluotitanate raw material, comprising the following steps:

step A': placing magnesium in the airtight resistance furnace, evacuating, introducing inert gas into the resistance furnace, and heating the magnesium to obtain molten magnesium;

step B': opening the reactor cover, adding a proper amount of sodium fluotitanate into the reactor, closing the reactor cover, detecting leakage, slowly heating the reactor to 150° C., evacuating and continuously heating the reactor to 250° C.;

step C': introducing inert gas into the reactor, and continuously heating the reactor to 900° C.;

step D': opening the valve, adjusting the stirring speed, dripping the molten magnesium, and controlling the temperature of reaction in a range from 900 to 1000° C.;

and step E': opening the reactor cover, removing the stirring device out of the reactor, and eliminating NaF and $MgF_2$ at upper layer to obtain sponge titanium.

Preferably, the mass ratio of the aluminum to the magnesium is 1:1 to 1:10.

The invention further provides a third technological method for preparing sponge titanium from sodium fluotitanate raw material, comprising the following steps:

step A": placing aluminum and magnesium in the airtight resistance furnace, evacuating, introducing inert gas into the resistance furnace, and heating the aluminum and the magnesium to obtain mixed liquid;

step B": opening the reactor cover, adding a proper amount of sodium fluotitanate into the reactor, closing the reactor cover, detecting leakage, slowly heating the reactor to 150° C., evacuating and continuously heating the reactor to 250° C.;

step C": introducing inert gas into the reactor, and continuously heating the reactor to 900° C.;

step D": opening the valve, adjusting the stirring speed, dripping the mixed liquid, and controlling the temperature of reaction in a range from 900 to 1000° C.;

and step E": opening the reactor cover, removing the stirring device out of the reactor, and eliminating $NaAlF_4$, NaF and $MgF_2$ at upper layer to obtain sponge titanium.

Preferably, the mass ratio of the aluminum to the magnesium is 18:1 to 1:1.

The invention has the advantages that: by adopting the technical proposal discussed above, the technological method is short in technological flow, low in cost, harmless and environment-friendly compared with traditional processes, and rivals the prior art for the reduction rate and yield of sponge titanium, furthermore, the final resultant sponge titanium can be directly applied to technological production, further saving resources and cost.

DETAILED DESCRIPTION OF THE PREFERRED EMBODIMENTS

The preferred embodiments of the invention will be described below in further details:

Proposal 1: method for preparing sponge titanium from sodium fluotitanate by aluminothermic reduction process:

The equation related is as follows:

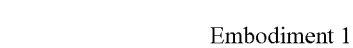

$$3Na_2TiF_6+4Al=3Ti+6NaF+4AlF_3$$

Embodiment 1

1. placing 36 g aluminum in an airtight resistance furnace, evacuating, introducing inert gas into the resistance furnace, and heating the aluminum to obtain molten aluminum;

2. opening the reactor cover, adding 240 g sodium fluotitanate into the reactor, closing the reactor cover, detecting leakage, slowly heating the reactor to 150° C., evacuating and continuously heating the reactor to 250° C.;

3. introducing inert gas into the reactor, continuously heating the reactor to 900° C., and stirring uniformly;

4. opening the valve, adjusting the stirring speed, dripping the molten aluminum, and controlling the temperature of reaction in a range from 900 to 1000° C.;

5. opening the reactor cover, removing the stirring device out of the reactor, and eliminating $NaAlF_4$ at upper layer to obtain 45.01 g sponge titanium; in the product, the titanium content is 87.76% and the reduction rate is 82.3%.

Embodiment 2

1. placing 40 g aluminum in an airtight resistance furnace, evacuating, introducing inert gas into the resistance furnace, and heating the aluminum to obtain molten aluminum;

2. opening the reactor cover, adding 240 g sodium fluotitanate into the reactor, closing the reactor cover, detecting leakage, slowly heating the reactor to 150° C., evacuating and continuously heating the reactor to 250° C.;

3. introducing inert gas into the reactor, continuously heating the reactor to 900° C., and stirring uniformly;

4. opening the valve, adjusting the stirring speed, dripping the molten aluminum, and controlling the temperature of reaction in a range from 900 to 1000° C.;

5. opening the reactor cover, removing the stirring device out of the reactor, and eliminating $NaAlF_4$ at upper layer to obtain 48.39 g sponge titanium; in the product, the titanium content is 97% and the reduction rate is 97.8%.

Embodiment 3

1. placing 44 g aluminum in an airtight resistance furnace, evacuating, introducing inert gas into the resistance furnace, and heating the aluminum to obtain molten aluminum;

2. opening the reactor cover, adding 240 g sodium fluotitanate into the reactor, closing the reactor cover, detecting leakage, slowly heating the reactor to 150° C., evacuating and continuously heating the reactor to 250° C.;

3. introducing inert gas into the reactor, continuously heating the reactor to 900° C., and stirring uniformly;

4. opening the valve, adjusting the stirring speed, dripping the molten aluminum, and controlling the temperature of reaction in a range from 900 to 1000° C.;

5. opening the reactor cover, removing the stirring device out of the reactor, and eliminating $NaAlF_4$ at upper layer to obtain 48.29 g sponge titanium; in the product, the titanium content is 98.6% and the reduction rate is 99.2%.

TABLE 1

Reaction Test Data

| Embodiment | Addition Amount of Raw Materials, g | | Theoretical Amount of Ti, g | Actual Sponge Titanium Product, g | Ti Content In Product, % | Reduction Rate, % |
|---|---|---|---|---|---|---|
| | $K_2TiF_6$ | Al | | | | |
| 1 | 240 | 36 | 48 | 50.22 | 90.8 | 95 |
| 2 | 240 | 40 | 48 | 48.39 | 97 | 97.8 |
| 3 | 240 | 44 | 48 | 48.29 | 98.6 | 99.2 |

Reduction Rate (%) = (Actual Sponge Titanium Product × Ti Content In Product)/Theoretical Amount of Ti Proposal 2: method for preparing sponge titanium from sodium fluotitanate by aluminothermic reduction process:

The equations related are as follows:

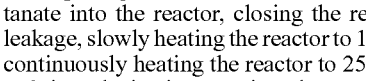

$$Na_2TiF_6+2Mg=Ti+2MgF_2+2NaF$$

Embodiment 4

1. placing magnesium in a resistance furnace, evacuating, introducing inert gas into the resistance furnace, and heating the magnesium to obtain molten magnesium;

2. opening the reactor cover, adding a calculation amount of sodium fluotitanate into the reactor, closing the reactor cover, detecting leakage, slowly heating the reactor to 150° C., evacuating and then heating the reactor to 250° C.;

3. introducing inert gas into the reactor, and continuously heating the reactor to 750° C.;

4. opening the valve, adjusting the stirring speed, dripping the molten magnesium, and controlling the temperature of reaction in a range from 900 to 1000° C.;

5. opening the reactor cover, removing the stirring device out of the reactor, and eliminating NaF and $MgF_2$ at upper layer to obtain 47.56 g sponge titanium; in the product, the titanium content is 99.2% and the reduction rate is 98.3%.

TABLE 2

Reaction Test Data

| Embodiment | Addition Amount of Raw Materials, g | | Theoretical Amount of Ti, g | Actual Sponge Titanium Product, g | Ti Content In Product, % | Reduction Rate, % |
|---|---|---|---|---|---|---|
| | $K_2TiF_6$ | Mg | | | | |
| 4 | 240 | 144 | 48 | 47.56 | 99.2 | 98.3 |

Proposal 3: method for preparing sponge titanium from sodium fluotitanate by aluminum-magnesium thermal reduction process:

The equations related are as follows:

$$3Na_2TiF_6+4Al=3Ti+6NaF+4AlF_3$$

$$Na_2TiF_6+2Mg=Ti+2MgF_2+2NaF$$

Embodiment 5

1. placing 36 g aluminum and 36 g magnesium in an airtight resistance furnace, evacuating, introducing inert gas into the resistance furnace, and heating the aluminum and the magnesium to obtain mixed liquid;

2. opening the reactor cover, adding 240 g sodium fluotitanate into the reactor, closing the reactor cover, detecting leakage, slowly heating the reactor to 150° C., evacuating and then heating the reactor to 250° C.;

3. introducing inert gas into the reactor, and continuously heating the reactor to 750° C.;

4. opening the valve, adjusting the stirring speed, dripping the mixed liquid, and controlling the temperature of reaction in a range from 900 to 1000° C.;

5. opening the reactor cover, removing the stirring device out of the reactor, and eliminating $NaAlF_4$, NaF and $MgF_2$ at upper layer to obtain 45.12 g sponge titanium; in the product, the titanium content is 96.5% and the reduction rate is 90.7%.

Embodiment 6

1. placing 36 g aluminum and 18 g magnesium in an airtight resistance furnace, evacuating, introducing inert gas into the resistance furnace, and heating the aluminum and the magnesium to obtain mixed liquid;

2. opening the reactor cover, adding 240 g sodium fluotitanate into the reactor, closing the reactor cover, detecting leakage, slowly heating the reactor to 150° C., evacuating and then heating the reactor to 250° C.;

3. introducing inert gas into the reactor, and continuously heating the reactor to 750° C.;

4. opening the valve, adjusting the stirring speed, dripping the mixed liquid, and controlling the temperature of reaction in a range from 900 to 1000° C.;

5. opening the reactor cover, removing the stirring device out of the reactor, and eliminating $NaAlF_4$, NaF and $MgF_2$ at upper layer to obtain 45.45 g sponge titanium; in the product, the titanium content is 98% and the reduction rate is 92.8%.

Embodiment 7

1. placing 36 g aluminum and 9 g magnesium in an airtight resistance furnace, evacuating, introducing inert gas into the resistance furnace, and heating the aluminum and the magnesium to obtain mixed liquid;

2. opening the reactor cover, adding 240 g sodium fluotitanate into the reactor, closing the reactor cover, detecting leakage, slowly heating the reactor to 150° C., evacuating and then heating the reactor to 250° C.;

3. introducing inert gas into the reactor, and continuously heating the reactor to 750° C.;

4. opening the valve, adjusting the stirring speed, dripping the mixed liquid, and controlling the temperature of reaction in a range from 900 to 1000° C.;

5. opening the reactor cover, removing the stirring device out of the reactor, and eliminating $NaAlF_4$, NaF and $MgF_2$ at upper layer to obtain 47.9 g sponge titanium; in the product, the titanium content is 99.5% and the reduction rate is 99.3%.

Embodiment 8

1. placing 36 g aluminum and 2 g magnesium in an airtight resistance furnace, evacuating, introducing inert gas into the resistance furnace, and heating the aluminum and the magnesium to obtain mixed liquid;

2. opening the reactor cover, adding 240 g sodium fluotitanate into the reactor, closing the reactor cover, detecting leakage, slowly heating the reactor to 150° C., evacuating and then heating the reactor to 250° C.;

3. introducing inert gas into the reactor, and continuously heating the reactor to 750° C.;

4. opening the valve, adjusting the stirring speed, dripping the mixed liquid, and controlling the temperature of reaction in a range from 900 to 1000° C.;

5. opening the reactor cover, removing the stirring device out of the reactor, and eliminating $NaAlF_4$, NaF and $MgF_2$ at upper layer to obtain 48.29 g sponge titanium; in the product, the titanium content is 98.9% and the reduction rate is 99.5%.

TABLE 3

Reaction Test Data

| Embodiment | Addition Amount of Raw Materials, g | | | Theoretical Amount of Ti, g | Actual Sponge Titanium Product, g | Ti Content In Product, % | Reduction Rate, % |
|---|---|---|---|---|---|---|---|
| | $Na_2TiF_6$ | Al | Mg | | | | |
| 5 | 240 | 36 | 36 | 48 | 45.12 | 96.5 | 90.7 |
| 6 | 240 | 36 | 18 | 48 | 45.45 | 98 | 92.8 |
| 7 | 240 | 36 | 9 | 48 | 47.9 | 99.5 | 99.3 |
| 8 | 240 | 36 | 2 | 48 | 48.29 | 98.9 | 99.5 |

Further detailed descriptions are made to the invention with reference to the preferred embodiments in the above discussions and it could not be considered that the embodiments of the invention are limited to these descriptions only. Many simple derivations or alternations could be made without departing from the concept of the invention by ordinary skilled in this art to which the invention pertains, and shall be contemplated as being within the scope of the invention.

What is claimed is:

1. A technological method for preparing sponge titanium from sodium fluotitanate raw material, characterized in that, devices for preparing sponge titanium include: a reactor and a reactor cover with a stirring device, wherein a sealing ring is arranged between the reactor cover and the reactor; a lifting device for controlling the lifting of the reactor cover is arranged on a side surface of the reactor cover, an airtight resistance furnace is further arranged above the reactor cover, a valve is arranged below the resistance furnace; and an evacuating tube and a gas filling tube are arranged above the reactor cover;

the method comprises the following steps:

step A: placing aluminum in the airtight resistance furnace, evacuating, introducing inert gas into the resistance furnace, and heating the aluminum to obtain molten aluminum;

step B: opening the reactor cover, adding sodium fluotitanate into the reactor, closing the reactor cover, detecting leakage, slowly heating the reactor to 150° C., evacuating and continuously heating the reactor to 250° C.;

step C: introducing inert gas into the reactor, continuously heating the reactor to 900° C., and stirring uniformly;

step D: opening the valve, adjusting a stirring speed, dripping the molten aluminum, and controlling a temperature of reaction in a range from 900 to 1000° C.; and step E: opening the reactor cover, removing the stirring device out of the reactor, and eliminating $NaAlF_4$ at an upper layer to obtain sponge titanium.

2. The method according to claim 1, wherein a time for dripping the molten aluminum in the step D is 4 hours.

3. The method according to claim 1, wherein the stirring speed is 60 r/min.

4. A technological method for preparing sponge titanium from sodium fluotitanate raw material, characterized in that, devices for preparing sponge titanium include: a reactor and a reactor cover with a stirring device, wherein a sealing ring is arranged between the reactor cover and the reactor; a lifting device for controlling the lifting of the reactor cover is arranged on a side surface of the reactor cover, an airtight resistance furnace is further arranged above the reactor cover, a valve is arranged below the resistance furnace; and an evacuating tube and a gas filling tube are arranged above the reactor cover;

the method comprises the following steps:

step A': placing magnesium in the airtight resistance furnace, evacuating, introducing inert gas into the resistance furnace, and heating the magnesium to obtain molten magnesium;

step B': opening the reactor cover, adding sodium fluotitanate into the reactor, closing the reactor cover, detecting leakage, slowly heating the reactor to 150° C., evacuating and continuously heating the reactor to 250° C.;

step C': introducing inert gas into the reactor, and continuously heating the reactor to 900° C.;

step D': opening the valve, adjusting a stirring speed, dripping the molten magnesium, and controlling a temperature of reaction in a range from 900 to 1000° C.; and step E': opening the reactor cover, removing the stirring device out of the reactor, and eliminating NaF and $MgF_2$ at an upper layer to obtain sponge titanium.

5. The method according to claim 4, wherein a time for dripping the molten magnesium in the step D is 4 hours.

6. The method according to claim 4, wherein the stirring speed is 60 r/min.

7. A technological method for preparing sponge titanium from sodium fluotitanate raw material, characterized in that, devices for preparing sponge titanium include: a reactor and a reactor cover with a stirring device, wherein a sealing ring is arranged between the reactor cover and the reactor; a lifting device for controlling the lifting of the reactor cover is arranged on side surface of the reactor cover, an airtight resistance furnace is further arranged above the reactor cover, a valve is arranged below the resistance furnace; and an evacuating tube and a gas filling tube are arranged above the reactor cover;

the method comprises the following steps:

step A": placing aluminum and magnesium in the airtight resistance furnace, evacuating, introducing inert gas into the resistance furnace, and heating the aluminum and the magnesium to obtain mixed liquid;

step B": opening the reactor cover, adding sodium fluotitanate into the reactor, closing the reactor cover, detecting leakage, slowly heating the reactor to 150° C., evacuating and continuously heating the reactor to 250° C.;

step C": introducing inert gas into the reactor, and continuously heating the reactor to 900° C.;

step D": opening the valve, adjusting a stirring speed, dripping the mixed liquid, and controlling a temperature of reaction in a range from 900 to 1000° C.; and step E": opening the reactor cover, removing the stirring device out of the reactor, and eliminating $NaAlF_4$, NaF and $MgF_2$ at an upper layer to obtain sponge titanium.

8. The method according to claim 7, wherein a mass ratio of the aluminum to the magnesium is 18:1 to 1:1.

9. The method according to claim 7, wherein a time for dripping the mixed liquid in the step D is 4 hours.

10. The method according to claim 7, wherein the stirring speed is 60 r/min.

* * * * *